US009753482B2

(12) United States Patent
Niederberger et al.

(10) Patent No.: US 9,753,482 B2
(45) Date of Patent: Sep. 5, 2017

(54) VOLTAGE REFERENCE SOURCE AND METHOD FOR GENERATING A REFERENCE VOLTAGE

(71) Applicant: ams AG, Unterpremstaetten (AT)

(72) Inventors: Mark Niederberger, Einsiedeln (CH); Thomas Mueller, Ermenswil (CH)

(73) Assignee: AMS AG, Unterpremstaetten (AT)

( * ) Notice: Subject to any disclaimer, the term of this patent is extended or adjusted under 35 U.S.C. 154(b) by 0 days.

(21) Appl. No.: 14/940,079

(22) Filed: Nov. 12, 2015

(65) Prior Publication Data

US 2016/0139621 A1 May 19, 2016

(30) Foreign Application Priority Data

Nov. 14, 2014 (EP) ..... 14193251

(51) Int. Cl.

| | |
|---|---|
| ***G05F 3/26*** | (2006.01) |
| ***G05F 3/30*** | (2006.01) |
| *G05F 3/24* | (2006.01) |

(52) U.S. Cl.

CPC ..... *G05F 3/267* (2013.01); *G05F 3/30* (2013.01); *G05F 3/24* (2013.01)

(58) Field of Classification Search

CPC ... G05F 3/20; G05F 3/26; G05F 3/267; G05F 3/30

See application file for complete search history.

(56) References Cited

U.S. PATENT DOCUMENTS

| | | | | |
|---|---|---|---|---|
| 3,887,863 A | | 6/1975 | Brokaw | |
| 4,636,710 A | * | 1/1987 | Stanojevic | G05F 3/30 323/280 |
| 4,689,549 A | * | 8/1987 | Davis | G05F 3/265 323/315 |
| 4,709,163 A | * | 11/1987 | Kasperkovitz | G05F 3/30 323/312 |

(Continued)

FOREIGN PATENT DOCUMENTS

EP 2557472 A1 2/2013

OTHER PUBLICATIONS

Papavassiliou, Ch.: "Translinear Circuits", Oct. 2007, retrieved from <http://cas.ee.ic.ac.uk/people/dario/files/E416/translinear-lores.pdf> on Sep. 10, 2014.

(Continued)

*Primary Examiner* — Timothy J Dole
*Assistant Examiner* — Yusef Ahmed
(74) *Attorney, Agent, or Firm* — McDermott Will & Emery LLP

(57) ABSTRACT

A voltage reference source includes a source block, a first resistor having a first terminal coupled to a first terminal of the source block, a reference output for providing a reference voltage, and a first and a second mirror transistor forming a first current mirror. The first mirror transistor couples a second terminal of the source block to a supply voltage terminal and the second mirror transistor couples the reference output to the supply voltage terminal. A series connection of a second resistor and a diode is arranged between the reference output and the first terminal of the first resistor. A mirror current flows through the second mirror transistor and the series connection to the first terminal of the first resistor.

13 Claims, 6 Drawing Sheets

(56) References Cited

U.S. PATENT DOCUMENTS 6,046,578 A * 4/2000 Feldtkeller ..... G05F 3/225 323/314
6,285,244 B1 9/2001 Goldberg
6,462,526 B1 10/2002 Tanase
7,170,337 B2 * 1/2007 Whittaker ..... G05F 3/267 323/316
7,242,240 B2 7/2007 Gierkink
7,944,283 B2 * 5/2011 Kim ..... G05F 3/30 323/312
8,421,433 B2 4/2013 Vyne
2003/0067291 A1 * 4/2003 Hong ..... G05F 3/30 323/315
2005/0184718 A1 * 8/2005 Brass ..... H03F 3/345 323/313
2006/0091875 A1 * 5/2006 Kimura ..... G05F 3/30 323/315
2006/0164158 A1 * 7/2006 Kimura ..... G05F 3/30 327/539
2006/0250178 A1 11/2006 Gierkink
2008/0007243 A1 * 1/2008 Matsumoto ..... G05F 3/30 323/313
2008/0067996 A1 * 3/2008 Murase ..... G05F 3/30 323/316
2008/0180070 A1 * 7/2008 Kushima ..... G05F 3/30 323/233
2009/0039949 A1 2/2009 Pietrobon
2009/0085549 A1 * 4/2009 Sengupta ..... G05F 3/30 323/313
2009/0251203 A1 * 10/2009 Kimura ..... G05F 3/30 327/538
2009/0289697 A1 * 11/2009 Gabillard ..... G05F 3/30 327/539
2011/0169475 A1 * 7/2011 Koyasu ..... G05F 3/267 323/311
2012/0169413 A1 * 7/2012 Choi ..... G05F 3/30 327/539
2013/0106391 A1 5/2013 Tran et al.
2013/0257396 A1 * 10/2013 Tung ..... G05F 3/30 323/265
2014/0103900 A1 4/2014 Lahiri
2014/0266139 A1 * 9/2014 Eberlein ..... G05F 3/16 323/313
2015/0185746 A1 * 7/2015 Wang ..... G05F 3/30 323/313
2016/0026204 A1 * 1/2016 de Cremoux ..... G05F 3/30 323/314
2016/0266598 A1 * 9/2016 Wong ..... G05F 3/267

OTHER PUBLICATIONS

Kuijk, K: "A Precision Reference Voltage Source", IEEE Journal of Solid-State Circuits, vol. SC-8, No. 3, Jun. 1973, pp. 222-226.
Toumazou, C. et al: "Analogue IC Design: the current-mode approach", IEEE Circuits and Systems Series 2, Dec. 1, 1992, Chapter 2.5: The translinear cross-quad, pp. 70-81.

* cited by examiner

VOLTAGE REFERENCE SOURCE AND METHOD FOR GENERATING A REFERENCE VOLTAGE

CROSS-REFERENCE TO RELATED APPLICATION

This application claims the benefit of priority under 35 U.S.C. §119 of European Patent Application No. 14193251.7, filed on Nov. 14, 2014, which is hereby incorporated by reference as if fully set forth herein.

BACKGROUND OF THE INVENTION

The present invention is related to a voltage reference source and a method for generating a reference voltage.

Integrated circuits often comprise a voltage reference source which generates a reference voltage. The reference voltage can be a signal with a low temperature dependency. The reference voltage should be realized as a low noise voltage.

Document U.S. Pat. No. 7,242,240 B1 describes a low noise bandgap circuit. The bandgap circuit comprises a plurality of cells. Each cell is formed of a plurality of bipolar transistors which form an amplifier. The amplifier generates a voltage that is proportional to the absolute temperature, abbreviated as PTAT. The plurality of cells is sequentially connected to add the voltages generated by each cell.

SUMMARY OF THE INVENTION

In an embodiment, a voltage reference source comprises a source block and a first resistor that comprises a first terminal coupled to a first terminal of the source block. A reference output of the voltage reference source is designed for providing a reference voltage. Moreover, the voltage reference source comprises a first and a second mirror transistor forming a first current mirror. The first mirror transistor couples a second terminal of the source block to a supply voltage terminal and the second mirror transistor couples the reference output to the supply voltage terminal. Furthermore, the voltage reference source comprises a series connection of a second resistor and a diode. The series connection is arranged between the reference output and the first terminal of the first resistor such that a mirror current flows through the second mirror transistor and the series connection to the first terminal of the first resistor.

It is an advantage of the voltage reference source that a low number of current paths between the supply voltage terminal and the reference potential terminal are required. Thus, the power consumption is low. The first resistor has a high contribution to the noise of the reference voltage. The noise of the resistor increases with its resistance value. Since the mirror current is fed back to the first resistor, the value of the first resistor can be small resulting in a low output noise of the reference voltage.

In an embodiment, the first resistor comprises a second terminal coupled to a reference potential terminal.

In an embodiment, the first and the second mirror transistor are both implemented as field-effect transistors or are both implemented as bipolar transistors. The first and the second mirror transistor are of the same transistor type. The first and the second mirror transistor may differ only in their current driving capability.

In an embodiment, a current driving capability of the second mirror transistor is the P-fold of a current driving capability of the first mirror transistor. The factor P is larger than 1. Thus, the mirror current is the P-fold of a second signal.

In an embodiment, a control terminal of the first mirror transistor is directly connected to a control terminal of the second mirror transistor. The control terminal of the first mirror transistor may be directly connected to a first terminal of the first mirror transistor. The first terminal of the first mirror transistor may be directly connected to the second terminal of the source block. The first terminal of the second mirror transistor may be directly connected to the reference output. Each second terminal of the first and the second mirror transistor may be directly connected to the supply voltage terminal.

In an embodiment, the reference voltage is a constant voltage. The reference voltage may have a low temperature coefficient. Optionally, the reference voltage may have a very low temperature dependency. The mirror current may be realized as a current proportional to the absolute temperature, abbreviated IPTAT. The flow of the mirror current through the second resistor may generate a voltage with positive temperature coefficient which compensates the negative temperature coefficient of the voltage generated by the flow of the mirror current through the diode.

In an embodiment, the reference voltage has a predetermined temperature coefficient. The coefficient may be non-zero. The coefficient may be positive or negative. The coefficient mainly may be a function of the resistance value of the second resistor.

In an embodiment, the source block provides a first signal at the first terminal that is implemented as a voltage. The first signal may be realized as a voltage proportional to the absolute temperature. Thus, the first signal is a voltage that drops across the first resistor. The first signal is the voltage between the first terminal of the first resistor and the second terminal of the first resistor.

In an embodiment, the source block provides the second signal at the second terminal that is implemented as a current and flows through the second terminal of the source block. The current may be proportional to the absolute temperature. The second signal is realized as a current that is mirrored by the first current mirror into the mirror current. Thus, the current which flows through the series connection of the second resistor and the diode to the first terminal of the first resistor depends on the second signal.

In an embodiment, the second signal that is implemented as a current not only flows through the second terminal of the source block but also through the first terminal of the source block.

In an embodiment, the source block comprises a first current path between the first and the second terminal of the source block. The second signal may flow through the first current path.

In an embodiment, the source block comprises a third terminal that is coupled to the reference potential terminal. The source block may comprise a second current path between the third and the second terminal of the source block.

In an embodiment, the source block comprises a fourth terminal that is coupled to the supply voltage terminal. The source block may comprise a second current path between the third and the fourth terminal of the source block.

In an embodiment, the voltage reference source comprises a current source which couples the fourth terminal of the source block to the supply voltage terminal.

In an embodiment, the current source is realized by a source resistor. The current source may be implemented without a transistor. Thus, the current source consists of only one circuit part. The current source may require only a low area on a semiconductor body that comprises the voltage reference source.

In an alternative embodiment, the current source comprises a source transistor. The current source may be implemented by a circuit comprising the source transistor and the source resistor. The source transistor and the source resistor may be serially connected between the supply voltage terminal and the fourth terminal of the source block. Thus, the current source is able to reduce influence of fluctuations in a supply voltage provided at the supply voltage terminal.

In an embodiment, the source block comprises a cross coupled transistor pair.

In an embodiment, the source block comprises the cross coupled transistor pair and a second current mirror.

In an embodiment, the source block comprises a first and a second transistor that are cross coupled. The cross coupled transistor pair is realized by the first and the second transistor. The first transistor is arranged between the first terminal of the source block and the second terminal of the source block. The second transistor is arranged between the third terminal of the source block and the fourth terminal of the source block. Each of the first and the second transistor has a first terminal, a second terminal and a control terminal. The first and the second transistor are cross-coupled by a connection of the first terminal of the first transistor to the control terminal of the second transistor and correspondingly by a connection of the first terminal of the second transistor to the control terminal of the first transistor.

In an embodiment, the first and the second transistor are realized as bipolar transistors. The first and the second transistor may be implemented as npn bipolar transistors. Thus, the first terminals of the first and the second transistor are realized as collector and the second terminals of the first and the second transistor are implemented as emitter. The control terminals of the first and the second transistor are implemented as base. The collector of the first transistor may be connected to the base of the second transistor and the collector of the second transistor may be connected to the base of the first transistor.

In an embodiment, a current driving capability of the first transistor is the N-fold of a current driving capability of the second transistor. The factor N may be larger than 1.

In an embodiment, the source block comprises a third and a fourth mirror transistor. The second current mirror is realized by the third and the fourth mirror transistor. The third mirror transistor is arranged in series to the first transistor and the fourth mirror transistor is arranged in series to the second transistor. Thus, a controlled section of the first transistor and a controlled section of the third mirror transistor are arranged in series and couple the second terminal of the source block to the first terminal of the source block. Similarly, a controlled section of the second transistor and a controlled section of the fourth mirror transistor are connected in series and couple the fourth terminal of the source block to the third terminal of the source block.

In an embodiment, the first transistor is connected to the first terminal of the source block and the third mirror transistor is connected to the second terminal of the source block. Moreover, the second transistor is connected to the third terminal of the source block, whereas the fourth mirror transistor is connected to the fourth terminal of the source block. The third and the fourth mirror transistor each have a first terminal, a second terminal and a control terminal. The control terminal of the third mirror transistor is connected to the control terminal of the fourth mirror transistor. Moreover, the control terminal of the fourth mirror transistor may be connected to the first terminal of the fourth mirror transistor.

In an embodiment, the third and the fourth mirror transistor are implemented as bipolar transistors. The third and the fourth mirror transistor may be realized as npn-bipolar transistors. Each of the third and the fourth mirror transistor has an emitter, a collector and a base. A base of the fourth mirror transistor is connected to a base of the third mirror transistor. The base of the fourth mirror transistor may be connected to an emitter of the fourth mirror transistor or an emitter of the third mirror transistor.

In an embodiment, a current driving capability of the fourth mirror transistor is the M-fold of a current driving capability of the third mirror transistor. The factor M may be larger than 1.

In an embodiment, the current source provides a source current. The source current flows through the second current path that is the series connection of the second transistor and the fourth mirror transistor. Thus, the source block is supplied by the current source and the first mirror transistor. The source block may exclusively be supplied by the current source and the first mirror transistor. The voltage reference source may have only two DC current paths between the supply voltage terminal and the source block which are implemented by the current source and the first mirror transistor. The voltage reference source may be free of a third DC current path between the supply voltage terminal and the source block.

In an embodiment, the voltage reference source comprises a capacitor that is arranged between the second terminal of the source block and the supply voltage terminal. The capacitor reduces variations of a voltage across the first and the second terminal of the first mirror transistor. Thus, a current flowing through the first mirror transistor and, consequently, the mirror current is stabilized by means of the capacitor. The mirror current has a larger value in comparison to the current flowing through the first terminal of the source block. A voltage drop across the first resistor is mainly caused by the mirror current. Thus, the reference voltage is stabilized by means of the capacitor.

In an embodiment, the capacitor may improve the stability of the loop of the voltage reference source. The capacitor may cause a frequency compensation of the loop of the voltage reference source.

In an embodiment, the source block comprises a first series circuit comprising a first diode and a first series transistor and connecting the first terminal of the source block to the second terminal of the source block.

In a further development, the source block comprises a second series circuit comprising a second diode and a second series transistor and connecting the third terminal of the source block to the second terminal of the source block. The first and the second diode are connected to the first and to the third terminal of the source block. The first and the second series transistor are connected to the second terminal of the source block. The first and the second series transistor are realized as field-effect transistors.

In an embodiment, the source block comprises an amplifier coupled on its input side to a node between the first diode and the first series transistor and to a node between the second diode and the second series transistor. The amplifier is coupled on its output side to a control terminal of the first series transistor and to a control terminal of the second series transistor. Thus, the supply voltage terminal may be connected twice to the source block, namely via the first mirror transistor and via a connection of the supply voltage terminal to a supply input of the amplifier.

In an embodiment, the voltage reference source is realized as a low noise voltage reference based on a cross-coupled quad of bipolar transistors. The cross-coupled quad of bipolar transistors comprises the second current mirror and the cross coupled transistor pair. It has an improved noise performance for the same supply current when compared with another Bandgap architecture. Another name for the cross-coupled quad is translinear loop, abbreviated as TL.

In an embodiment, a method for generating a reference voltage comprises providing a first signal at a first terminal of a source block. The first terminal of the source block is coupled to a first terminal of a first resistor. Moreover, a second signal that is implemented as a current is provided at a second terminal of a source block. The second signal is mirrored into a mirror current by a first current mirror comprising a first and a second mirror transistor. The first mirror transistor couples the second terminal of the source block to a supply voltage terminal and the second mirror transistor couples a reference output to the supply voltage terminal. Furthermore, the mirror current is provided via a series connection of a second resistor and a diode to the first terminal of the first resistor. The reference voltage is provided at the reference output.

Advantageously, only a small number of current paths and devices is required for generating the reference voltage. Thus, a power consumption is kept low. The reference voltage is generated with a low noise, since a small value of the resistance of the first resistor can be selected.

In an embodiment, the source block is an electric circuit. The source block comprises an active element such as a transistor. The source block acts as a current source or current sink that provides the second signal. Additionally, the source block acts as a current source or a voltage source that provides the first signal. The first signal may be a current or a voltage or a combination of a current and a voltage.

BRIEF DESCRIPTION OF THE DRAWINGS

The following description of figures of exemplary embodiments may further illustrate and explain the invention. Circuit parts, devices and circuit blocks with the same structure and the same effect, respectively, appear with equivalent reference symbols. In so far as circuit parts, devices or circuit blocks correspond to one another in terms of their function in different figures, the description thereof is not repeated for each of the following figures.

DETAILED DESCRIPTION

Figure 1:
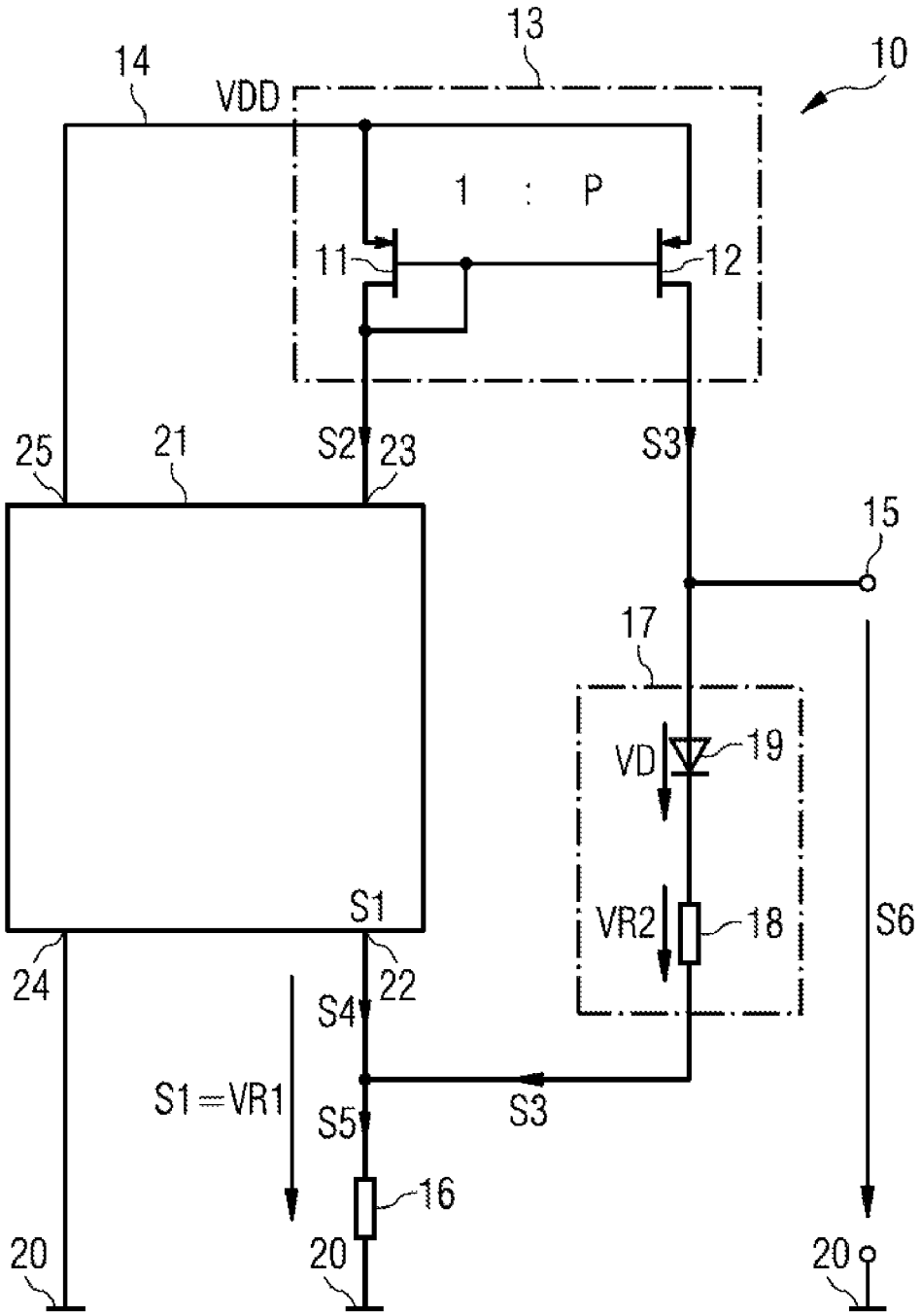
FIGS. 1, 2, 3A, 3B, and 4 show exemplary embodiments of a voltage reference source.

FIG. 1 shows an exemplary embodiment of a voltage reference source 10 comprising a first and a second mirror transistor 11, 12 which form a first current mirror 13. Moreover, the voltage reference source 10 comprises a supply voltage terminal 14 and a reference output 15. The first current mirror 13 couples the supply voltage terminal 14 to the reference output 15. A controlled section of the second mirror transistor 12 is arranged between the supply voltage terminal 14 and the reference output 15.

Moreover, the voltage reference source 10 comprises a first resistor 16 having a first and a second terminal. The voltage reference source 10 comprises a series connection 17 of a second resistor 18 and a diode 19. The series connection 17 is connected on the one side to the reference output 15 and on the other side to the first terminal of the first resistor 16. The second terminal of the first resistor 16 is directly connected to a reference potential terminal 20. The diode 19 is connected to the reference output 15, whereas the second resistor 18 is connected to the first terminal of the first resistor 16.

Furthermore, the voltage reference source 10 comprises a source block 21 having a first and a second terminal 22, 23. The first terminal 22 of the source block 21 is connected to the first terminal of the first resistor 16. The second terminal 23 of the source block 21 is connected to the first current mirror 13. Thus, a controlled section of the first mirror transistor 11 is arranged between the supply voltage terminal 14 and the second terminal 23 of the source block 21. Additionally, the source block 21 comprises a third terminal 24 that is connected to the reference potential terminal 20. A fourth terminal 25 of the source block 21 is coupled to the supply voltage terminal 14.

A control terminal of the first mirror transistor 11 is connected to a control terminal of the second mirror transistor 12. The first and the second mirror transistor 11, 12 are implemented as field-effect transistors. The first and the second mirror transistor 11, 12 may be realized as p-channel metal-oxide-semiconductor field-effect transistors. The control terminal of the first mirror transistor 11 is connected to a first terminal of the first mirror transistor 11 and thus to the second terminal 23 of the source block 21.

A first signal S1 is provided at the first terminal 22 of the source block 21. A second signal S2 is provided at the second terminal 23 of the source block 21. The first signal S1 is realized as a voltage. The voltage is implemented as a voltage proportional to the absolute temperature, abbreviated VPTAT. The first signal S1 drops across the first resistor 16.

The second signal S2 is implemented as a current. The second signal S2 may be realized as a current proportional to the absolute temperature, abbreviated IPTAT. The second signal S2 is mirrored by the first current mirror 13 into a mirror current S3. A current driving capability of the second mirror transistor 12 is a P-fold of a current driving capability of the first mirror transistor 11. The factor P may be larger than 1. The factor P may be also named current mirror ratio of the first current mirror 13. Thus, the mirror current S3 can be calculated by means of the following equation:

$$S3=S2\cdot P,$$

wherein S2 is the second signal that is realized as a current. The mirror current S3 flows through the series connection 17. Thus, the mirror current S3 and an output current S4 flowing through the first terminal 22 of the source block 21 flow through the first resistor 16 to the reference potential terminal 20. A resistor current S5 can be calculated according to the following equation:

$$S5=S3+S4=P\cdot S2+S4$$

The resistor current S5 is also a current proportional to the absolute temperature, abbreviated IPTAT. The first signal S1 can be calculated according to the following equation:

$$S1=R1\cdot S5=(S4+P\cdot S2)\cdot R1$$

A reference voltage S6 can be tapped at the reference output 15. The reference voltage S6 drops across the series circuit of the series connection 17 and the first resistor 16. A supply voltage VDD is applied to the supply voltage terminal 14.

Figure 5A:
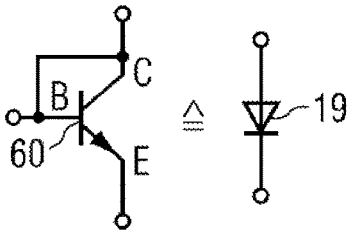
FIGS. 5A and 5B show exemplary embodiments of a diode of the voltage reference source.
Figure 5B:
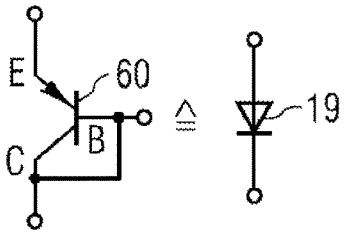

The diode 19 may be fabricated as a single pn-junction. Alternatively, the diode 19 may be realized as a bipolar transistor 60 as shown in FIGS. 5A and 5B. The diode 19 may be realized by using a pn-junction of the bipolar transistor 60.

In an alternative embodiment, not shown, the diode 19 is connected to the first terminal of the first resistor 16, whereas the second resistor 18 is connected to the reference output 15.

In an alternative embodiment, not shown, the first and the second mirror transistor 11, 12 are implemented as bipolar transistors.

Figure 2:
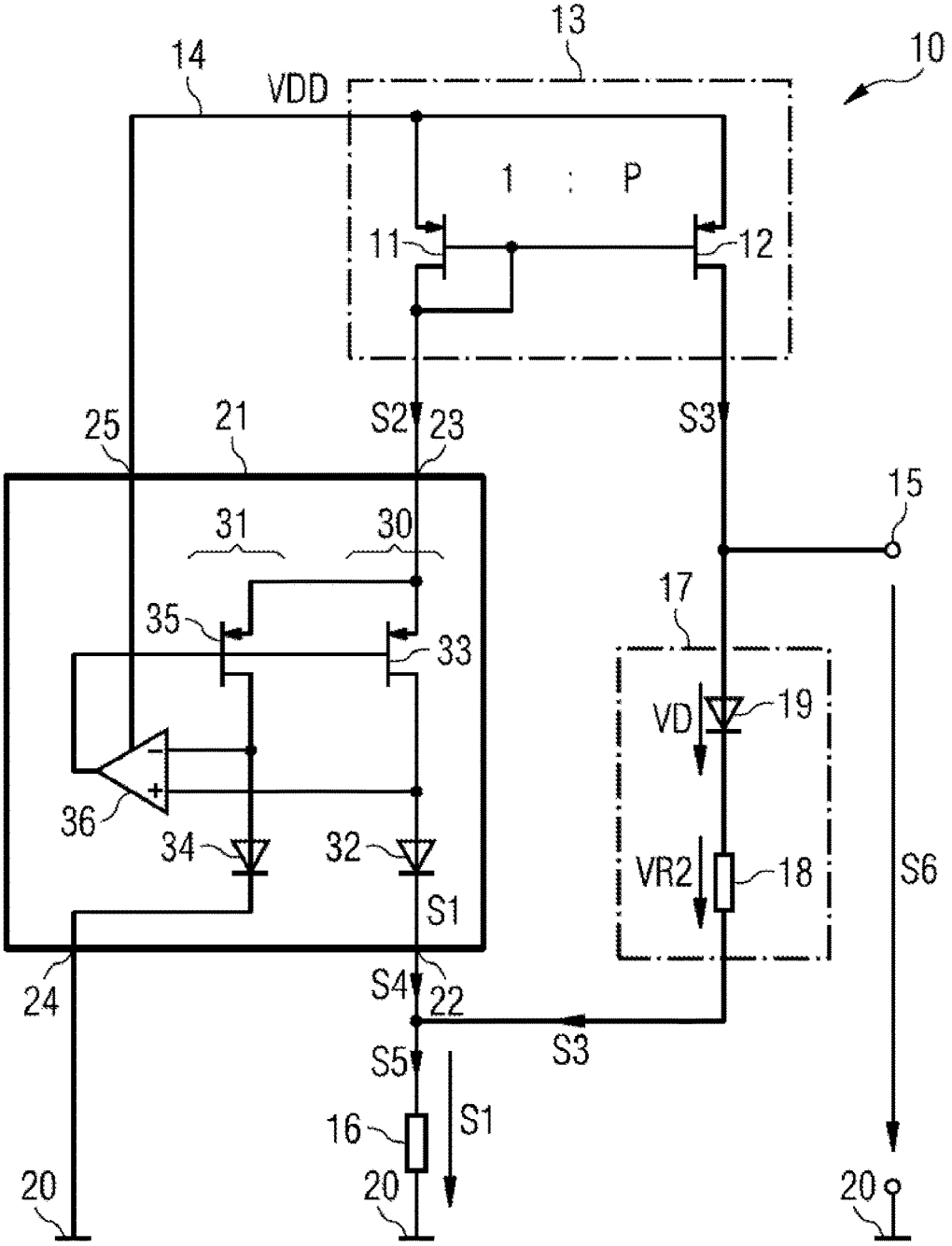

FIG. 2 shows an alternative embodiment of the voltage reference source 10 which is a further development of the embodiment shown in FIG. 1. The source block 21 comprises a first and a second series circuit 30, 31. The first series circuit 30 connects the second terminal 23 of the source block 21 to the first terminal 22 of the source block 21. The second series circuit 31 connects the second terminal 23 of the source block 21 to the third terminal 24 of the source block 21. The first series circuit 30 comprises a first diode 32 and a first series transistor 33. The first series transistor 33 is connected to the second terminal 23 of the source block 21, whereas the first diode 32 is connected to the first terminal 22 of the source block 21. Correspondingly, the second series circuit 31 comprises a second diode 34 and a second series transistor 35. Whereas the second series transistor 35 is connected to the second terminal 23 of the source block 21, the second diode 34 is connected to the third terminal 24 of the source block 21.

Moreover, the source block 21 comprises an amplifier 36 having a first and a second input. The first input of the amplifier 36 is coupled to a node between the first diode 32 and the first series transistor 33. Similarly, the second input of the amplifier 36 is connected to a node between the second diode 34 and the second series transistor 35. The first input is realized as a non-inverting input and the second input is realized as an inverting input of the amplifier 36. An output of the amplifier 36 is connected to a control terminal of the first series transistor 33 and to a control terminal of the second series transistor 35. A supply input of the amplifier 36 is coupled via the fourth terminal 25 of the source block 21 to the supply voltage terminal 14. The first and the second series transistor 33, 35 are realized as field-effect transistors. Both transistors 33, 35 may be implemented as p-channel metal-oxide-semiconductor field-effect transistors.

In an alternative embodiment, not shown, the first and the second series transistor 33, 35 are realized as bipolar transistors.

Figure 3A:
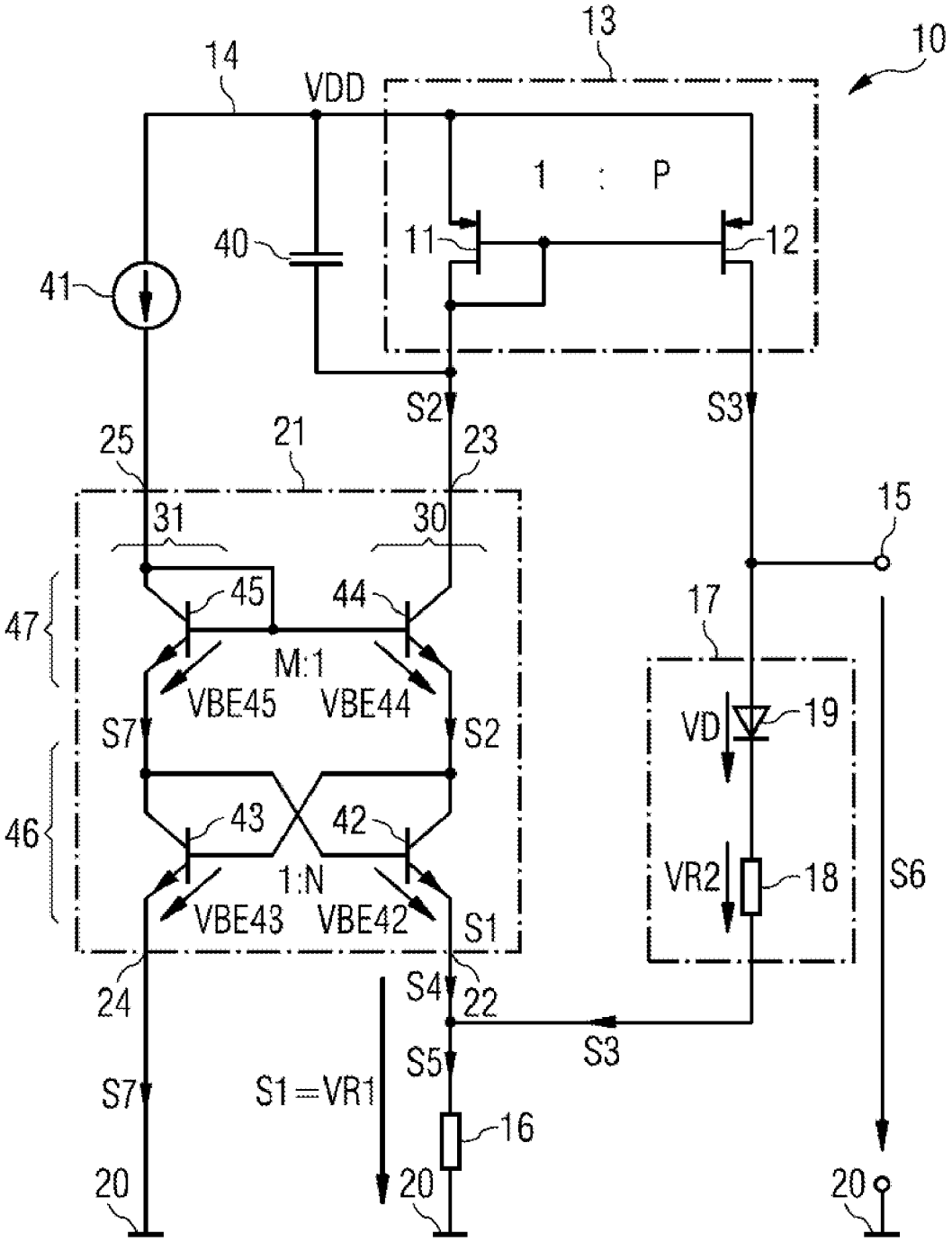

FIG. 3A shows an alternative exemplary embodiment of the voltage reference source 10 which is a further development of the embodiments shown in FIGS. 1 and 2. The voltage reference source 10 comprises a capacitor 40 that is coupled to the first current mirror 13. The capacitor 40 connects a first terminal of the first mirror transistor 11 to a second terminal of the first mirror transistor 11. Thus, the capacitor 40 stabilizes a voltage across the controlled section of the first mirror transistor 11. Consequently, the capacitor 40 stabilizes the second signal S2 that flows as a current through the first mirror transistor 11 and, therefore, also the mirror current S3 flowing through the second mirror transistor 12.

Additionally, the voltage reference source 10 comprises a current source 41. The current source 41 is arranged between the fourth terminal 25 of the source block 21 and the supply voltage terminal 14. The current source 41 may be realized by a not shown source resistor 50.

The source block 21 is implemented as a cross coupled quad. Quad means that the source block 21 comprises four transistors 42-45. The source block 21 may not comprise more transistors than four transistors. The source block 21 may be implemented as a cross coupled quad of bipolar transistors 42-45. The source block 21 comprises the first and the second series circuit 30, 31. The first series circuit 30 is arranged between the second terminal 23 and the first terminal 22 of the source block 21. The second series circuit 31 is arranged between the fourth terminal 25 and the third terminal 24 of the source block 21. The source block 21 comprises a first and a second transistor 42, 43 that are cross-coupled. The first and the second transistor 42, 43 form a cross coupled transistor pair 46. The first series circuit 30 comprises the first transistor 42, whereas the second series circuit 31 comprises the second transistor 43. A control terminal of the first transistor 42 is connected to a first terminal of the second transistor 43. Correspondingly, a control terminal of the second transistor 43 is connected to a first terminal of the first transistor 42.

Moreover, the source block 21 comprises a third and a fourth mirror transistor 44, 45 forming a second current mirror 47. The third mirror transistor 44 is comprised by the first series circuit 30, whereas the fourth mirror transistor 45 is comprised by the second series circuit 31. The first transistor 42 is connected to the first terminal 22 of the source block 21, whereas the third mirror transistor 44 is connected to the second terminal 23 of the source block 21. Correspondingly, the second transistor 43 is connected to the third terminal 24 of the source block 21, whereas the fourth mirror transistor 45 is connected to the fourth terminal 25 of the source block 21. The fourth mirror transistor 45 may be directly connected to the fourth terminal 25 of the source block 21. A control terminal of the third mirror transistor 44 is connected to a control terminal of the fourth mirror transistor 45. The control terminal of the fourth mirror transistor 45 is also connected to a first terminal of the fourth mirror transistor 45 and thus to the fourth terminal 25 of the source block 21.

The first and the second transistor 42, 43 and the third and the fourth mirror transistor 44, 45 are implemented as bipolar transistors. Said four transistors 42-45 may be implemented as npn bipolar transistors.

In an alternative, not shown, embodiment, the first and the second transistor 42, 43 and/or the third and the fourth mirror transistor 44, 45 are implemented as field-effect transistors.

Figure 3B:
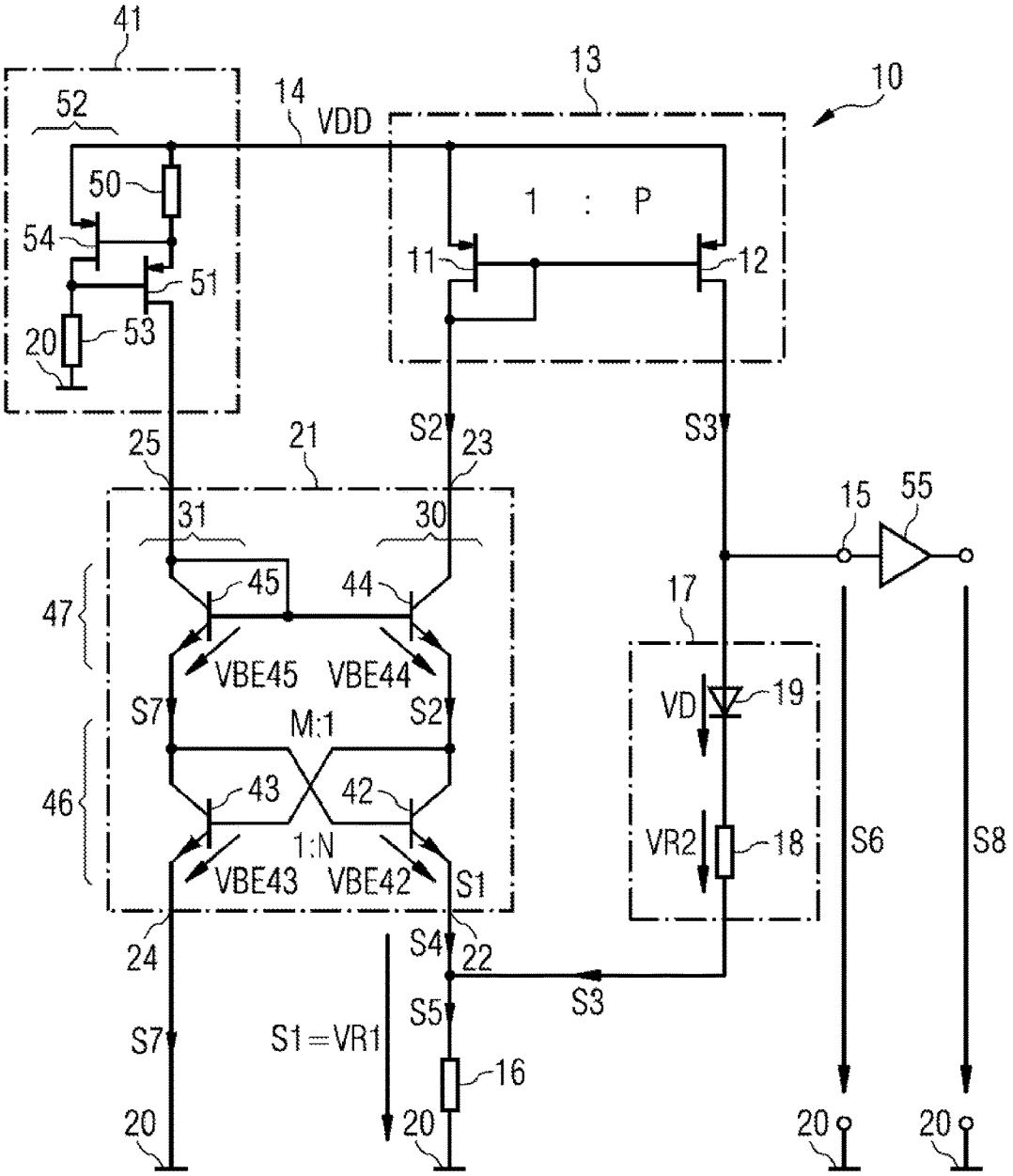

FIG. 3B shows an alternative embodiment of the voltage reference source 10 which is a further development of the embodiments shown in FIGS. 1, 2 and 3A. The capacitor 40 as shown in FIG. 3A is omitted. Thus, the capacitor 40 is an optional device of the voltage reference source 10.

The current source 41 comprises the source resistor 50 that is arranged between the fourth terminal 25 of the source block 21 and the supply voltage terminal 14. Moreover, the current source 41 comprises a source transistor 51 that is arranged in series to the source resistor 50. Moreover, the current source 41 comprises a current path 52 that couples the supply voltage terminal 14 to the reference potential terminal 20. A node of the current path 52 is connected to a control terminal of the source transistor 51. The source transistor 51 is connected to the fourth terminal 25 of the source block 21 and the source resistor 50 is connected to the supply voltage terminal 14.

The current path 52 comprises a further source resistor 53 and a further source transistor 54 that are connected in series. The further source transistor 54 is connected to the supply voltage terminal 14, whereas the further source resistor 53 is connected to the reference potential terminal 20. A node between the further source resistor 53 and the further source transistor 54 is connected to the control terminal of the source transistor 51. A node between the controlled section of the source transistor 51 and the source resistor 50 is connected to a control terminal of the further source transistor 54. Thus, the current source 41 is implemented with a small number of devices. The current source 41 increases the power supply rejection ratio. The current source 41 may be implemented also by other current source circuits.

Furthermore, the voltage reference source 10 comprises a buffer 55 that is connected on its input side to the reference output 15. At an output of the buffer 55, a buffered reference voltage S8 is provided.

The voltage reference source 10 uses a cross-coupled quad of bipolar transistors 42-45 for generating the first signal S1. The first signal S1 is a PTAT voltage across the first resistor 16. Contrary to the voltage reference source 10 shown in FIG. 4, the branch with the diode 19 and the second resistor 18 is not connected to the reference potential terminal 20, said branch is fed back to the first resistor 16. A current signal S7 that is a current I1 through the second series circuit 31 of the transistors 43, 45 is generated by the current source 41. The current source 41 as shown in FIG. 3B performs an improved power supply rejection.

In the following equations, the base currents of the transistors 42-45 are neglected because it is assumed that the current gain β of these transistors 42-45 is large (β>>1):

$$V_{BE45} + V_{BE42} + V_{R1} = V_{BE44} + V_{BE43}$$

$$V_T \cdot \ln\left(\frac{I_1}{M \cdot I_S}\right) + V_T \cdot \ln\left(\frac{I_2}{M \cdot I_S}\right) + R_1 \cdot I_2 \cdot (1 + P) = V_T \cdot \ln\left(\frac{I_2}{I_S}\right) + V_T \cdot \ln\left(\frac{I_1}{I_S}\right)$$

$$I_2 = \frac{V_T}{(1 + P) \cdot R_1} \cdot \ln(M \cdot N) \ (= PTAT \text{ current})$$

wherein VBE45 is a base-emitter voltage of the fourth mirror transistor 45, VBE42 is a base-emitter voltage of the first transistor 42, VR1 is a voltage value of the first signal S1, VBE44 is a base-emitter voltage of the third mirror transistor 44, VBE43 is a base-emitter voltage of the second transistor 43, VT is a thermal voltage, I1 is a value of the current signal S7 flowing through the second transistor 43, M is a factor, IS a reverse bias saturation current, N is a factor, R1 is a resistance value of the first resistor 16 and P is a factor. The voltage value VR1 of the first signal S1 is equal to the voltage drop across the first resistor 16. I2 is a current value of the second signal S2 flowing through the second terminal 23 of the source block 21 and is also equal to the output current S4 flowing through the first terminal 22 of the source block 21.

The factor M is defined such that a current driving capability of the fourth mirror transistor 45 is the M-fold of a current driving capability of the third mirror transistor 44. The factor M may be also named current mirror ratio of the second current mirror 47. The factor M may be larger than 1. The factor N is defined such that a current driving capability of the first transistor 42 is the N-fold of a current driving capability of the second transistor 43. The factor N may be larger than 1. The factor N may be also named cross coupled transistor ratio.

The reference voltage S6 that is also named Bandgap voltage VBG can be calculated as $$S6 = V_{BG} = V_D + V_{R_2} + V_{R_1}$$

$$S6 = V_{BG} = V_D + P \cdot I_2 \cdot R_2 + (P + 1) \cdot I_2 \cdot R_1$$

$$S6 = V_{BG} = V_D + V_T \cdot \ln(M \cdot N) \cdot \left(1 + \frac{P}{P + 1} \cdot \frac{R_2}{R_1}\right)$$

wherein VD is a diode forward voltage of the diode 19, VR2 is a voltage drop across the second resistor 18 and R2 is a resistance value of the second resistor 18.

In the voltage reference source 10, the output branch comprising the diode 19 and the second resistor 18 is fed back into a node between the first resistor 16 and the first transistor 42. The mirror current S3 that is realized as a fed back current is a multiple of the collector current of the third mirror transistor 44 (current mirror ratio P).

Figure 4:
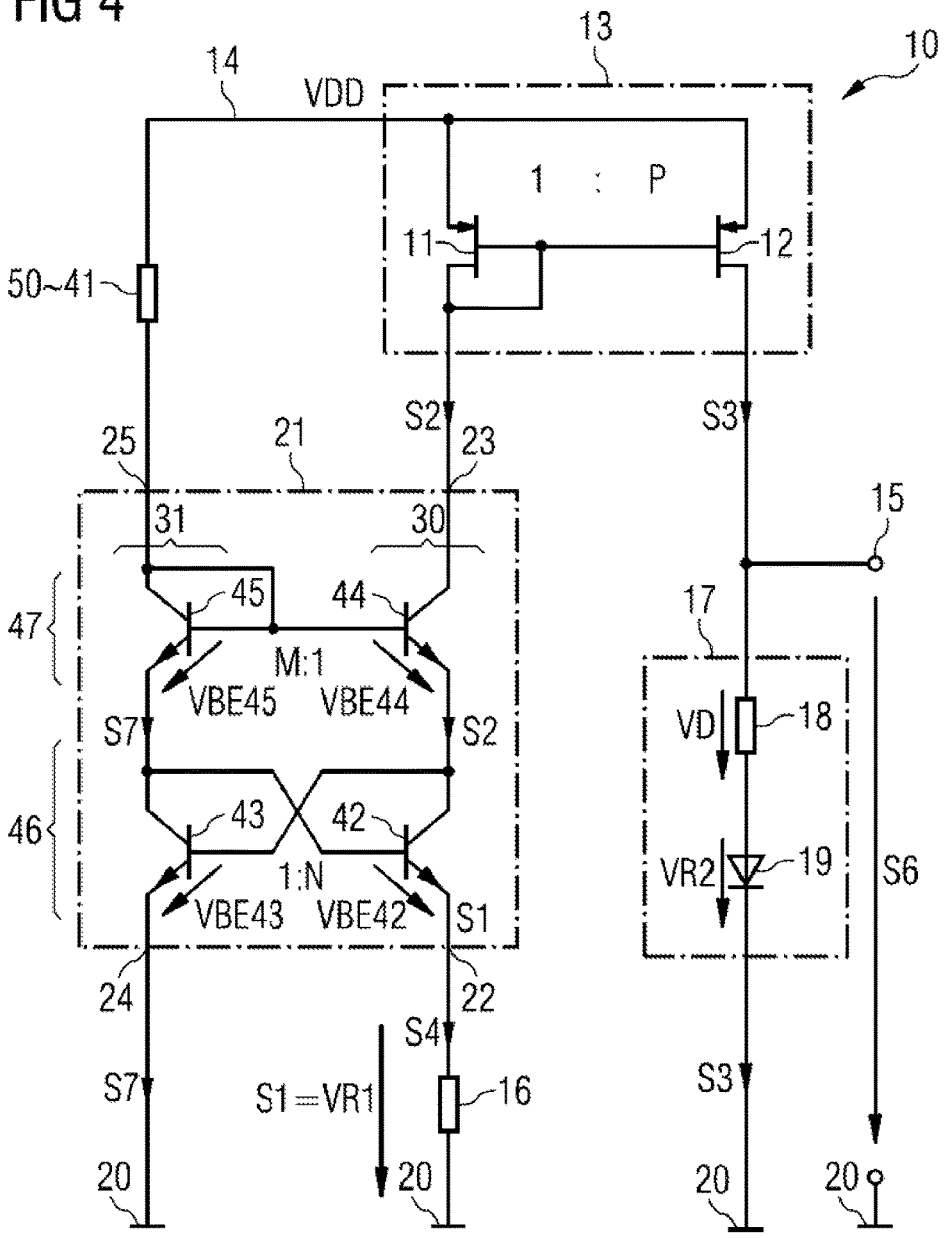

In the voltage reference source 10, the noise gain for the noise from the first resistor 16 is the same as in the circuit shown in FIG. 4, if the current mirror ratio P is large. But due to the mirror current S3, the value of the first resistor 16 can be smaller especially for the same supply current and, therefore, the output noise of the reference voltage S6 is lower.

The source block 21 is realized as the cross coupled quad and is designed for generation of the second signal S2 that is a PTAT current. By connecting the series connection 17 to the first terminal of the first resistor 16, a feedback of the output branch of the voltage reference source 10 is realized.

A first terminal of the source resistor 50 is coupled to the fourth terminal 25 of the source block 21. A second terminal of the source resistor 50 is coupled to the supply voltage terminal 14.

Advantageously, the voltage reference source 10 is started by the current source 41. This is achieved mainly by the source resistor 50. The voltage reference source 10 may be free of an additional start-up circuit.

FIG. 4 shows an alternative embodiment of the voltage reference source 10 which is a further development of the embodiments shown in FIGS. 1, 2, 3A and 3B. The current source 51 is implemented by the source resistor 50. The first terminal of the source resistor 50 is directly connected to the fourth terminal 25 of the source block 21. The second terminal of the source resistor 50 is directly connected to the supply voltage terminal 14. Thus, the current source 51 is free of any transistor. The series connection 17 is arranged between the reference output 15 and the reference potential terminal 20. Thus, the series connection 17 does not couple the reference output 15 to the first terminal of the first resistor 16. Consequently, the mirror current S3 flows through the series connection 17 directly to the reference potential terminal 20. The diode 19 is connected to the reference potential terminal 20, whereas the second resistor 18 is connected to the reference output 15.

In an alternative embodiment, not shown, the diode 19 is connected to the reference output 15 and the second resistor 18 is connected to the reference potential terminal 20.

The voltage reference source 10, as shown in FIGS. 3A, 3B and 4, is implemented as a Bandgap circuit. The voltage reference source 10 uses a cross-coupled quad of bipolar transistors 42-45 for generating a PTAT voltage across the first resistor 16. Another name for the cross-coupled quad is translinear loop TL. The cross-coupled quad is used for a PTAT current generator. Used in a Bandgap circuit, the PTAT current is mirrored into the output branch that comprises the diode 19 and the second resistor 18 by the first current mirror 13. The mirror current S3 realized as PTAT current through the second resistor 18 generates a voltage with positive temperature coefficient for compensating the negative temperature coefficient of the diode 19.

The voltage reference source 10 implemented as a Bandgap and based on the cross-coupled quad has the following properties: No startup circuit is needed. The voltage reference source 10 only has a single stable operating point and is free of a startup circuit. Moreover, the first signal S1 that is a PTAT voltage is large due to the stacked transistor arrangement:

S1=VPTAT=VT·ln(M·N). The voltage reference source 10 as shown in one of the Figures above multiplies the PTAT voltage.

FIGS. 5A and 5B show exemplary embodiments of the diode 19. The diode 19 is implemented by a bipolar transistor 60. As shown in FIG. 5A, the diode 19 is realized by an npn-bipolar transistor. The base and the collector of the bipolar transistor 60 are connected together. Thus, the diode 19 is formed by the base-emitter junction of the bipolar transistor 60.

As shown in FIG. 5B, the diode 19 is realized by a pnp-bipolar transistor. The base of the bipolar transistor 60 is connected to the collector of the bipolar transistor 60. Thus, the diode 19 is formed by the base-collector junction of the bipolar transistor 60.

Figure 6:
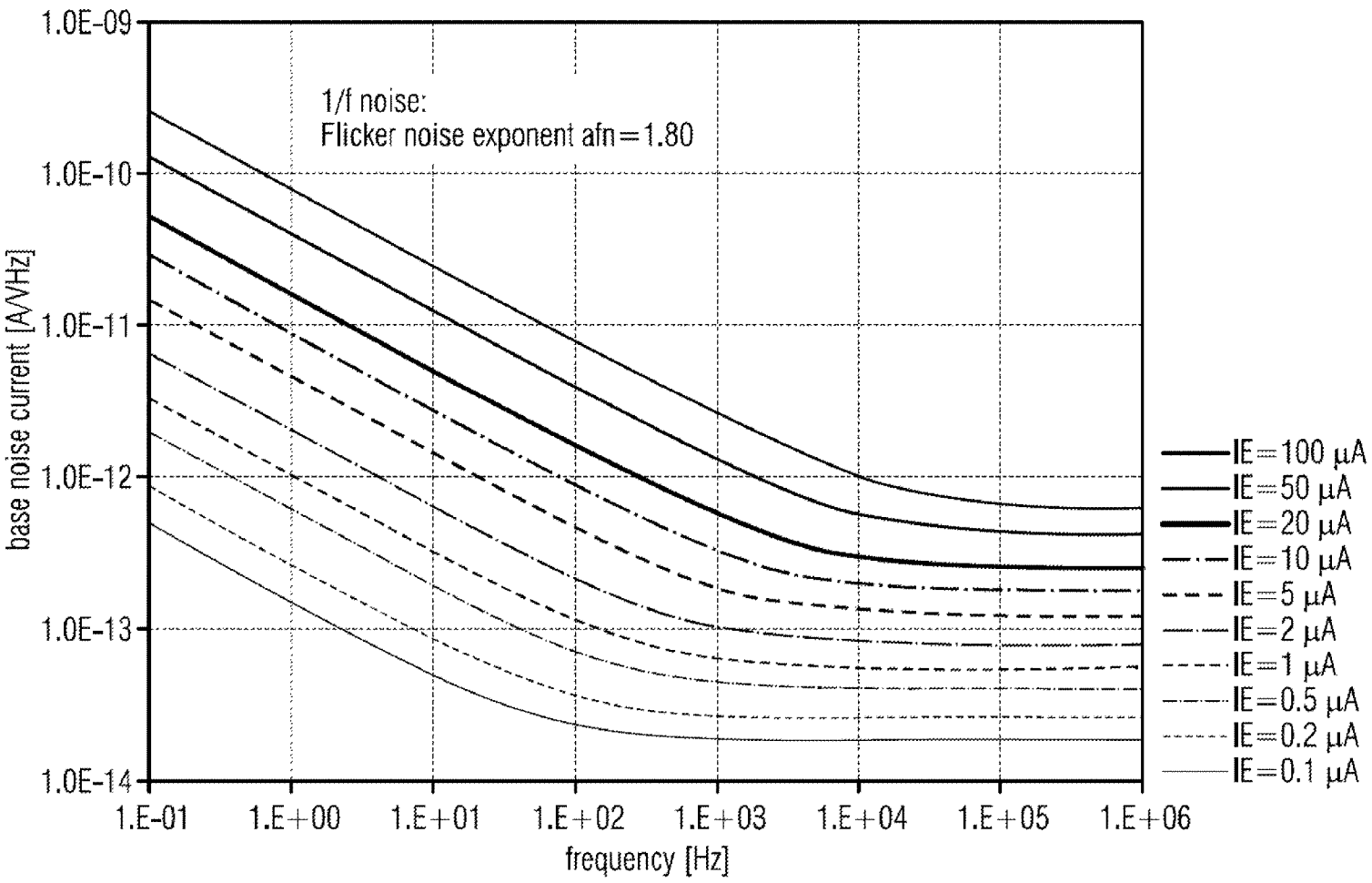
FIG. 6 shows an exemplary characteristic of a current flowing in a voltage reference source.

FIG. 6 shows an exemplary characteristic of the voltage reference source 10. A base noise current is shown depending on the frequency and the current value. As shown at the lower frequency values, a 1/f noise occurs. The flicker noise exponent AFN has a value of 1.8.

For good low frequency noise performance the current through the bipolar transistors 42-45 should be kept low due to their 1/f behavior. In FIG. 6, the noise of the base current of an npn transistor is depicted. The white noise current only increases with the square root of the emitter current, while the 1/f noise current increases almost proportional to the emitter current. For minimizing the 1/f noise, the current through the transistors 42, 44 of the first series circuit 30 should be kept small, while for good white noise performance the current through the first resistor 16 should be large, resulting in a small resistance value for the first resistor 16. This can be accomplished in the voltage reference source 10 as shown in FIGS. 1, 2, 3A and 3B by choosing a large current mirror ratio of the first current mirror 14 (P>1).

Further, the added feedback loop leads to the following improved circuit properties: the noise of the first transistor 42 and of the third mirror transistor 44 may be attenuated. The noise of the third and the fourth mirror transistors 44, 45 may be attenuated. The noise of the first and the second mirror transistors 11, 12 may be attenuated. Therefore, the first to the fourth current mirror transistor 11, 12, 44, 45 can be kept small without increasing the 1/f noise level of the reference voltage S6.

The matching requirement of the first current mirror 13 may be reduced. Also the matching requirement of the second current mirror 47 may be reduced.

The reference output 15 at which the reference voltage S6 is tapped has a lower impedance.

First simulation runs of the voltage reference source 10 led to the following simulated noise values: White noise: 29 nV/√Hz and 1/f noise: 49 nV/√Hz at a frequency f=10 Hz.

Advantageously, the voltage reference source 10 as shown in the FIGS. 3A, 3B and 4 implements a low noise voltage reference with cross-coupled quad bipolar transistors 42-45.

We claim:

1. A voltage reference source, comprising:

a source block;

a first resistor having a first terminal coupled to a first terminal of the source block;

a reference output for providing a reference voltage;

a first and a second mirror transistor forming a first current mirror, wherein the first mirror transistor couples a second terminal of the source block to a supply voltage terminal and the second mirror transistor couples the reference output to the supply voltage terminal; and a series connection of a second resistor and a diode that is arranged between the reference output and the first terminal of the first resistor such that a mirror current flows through the second mirror transistor and the series connection to the first terminal of the first resistor, wherein the source block comprises a third terminal that is coupled to a reference potential terminal, a fourth terminal that is coupled to the supply voltage terminal, and a first and a second transistor that are cross coupled by a connection of a first terminal of the first transistor to a control terminal of the second transistor and a connection of a first terminal of the second transistor to a control terminal of the first transistor, and wherein the first transistor is arranged between the first terminal of the source block and the second terminal of the source block and the second transistor is arranged between the third terminal of the source block and the fourth terminal of the source block.

2. The voltage reference source according to claim 1, wherein the source block is configured to provide a first signal at the first terminal of the source block that is implemented as a voltage proportional to the absolute temperature.

3. The voltage reference source according to claim 1, wherein the source block is configured to provide a second signal at the second terminal of the source block that is implemented as a current proportional to the absolute temperature and flows through the second terminal of the source block.

4. The voltage reference source according to claim 1, wherein a current driving capability of the second mirror transistor is P times a current driving capability of the first mirror transistor, and P is greater than 1.

5. The voltage reference source according to claim 1, wherein a control terminal of the first mirror transistor is directly connected to a control terminal of the second mirror transistor.

6. The voltage reference source according to claim 1, wherein the first and the second mirror transistor are both implemented as field-effect transistors or are both implemented as bipolar transistors.

7. The voltage reference source according to claim 1, comprising a current source which couples the fourth terminal of the source block to the supply voltage terminal.

8. The voltage reference source according to claim 7, wherein the current source comprises a source resistor that is arranged between the fourth terminal of the source block and the supply voltage terminal.

9. The voltage reference source according to claim 1, wherein a current driving capability of the first transistor is N times a current driving capability of the second transistor, and N is greater than 1.

10. The voltage reference source according to claim 1, wherein the source block comprises a third and a fourth mirror transistor forming a second current mirror, as well as the third mirror transistor is arranged in series to the first transistor and the fourth mirror transistor is arranged in series to the second transistor.

11. The voltage reference source according to claim 10, wherein a current driving capability of the fourth mirror transistor is M times a current driving capability of the third mirror transistor, and M is greater than 1.

12. A method for generating a reference voltage, comprising:

providing a first signal at a first terminal of a source block, wherein the first terminal of the source block is coupled to a first terminal of a first resistor;

providing a second signal implemented as a current at a second terminal of the source block;

mirroring the second signal into a mirror current by a first current mirror comprising a first and a second mirror transistor such that the first mirror transistor couples the second terminal of the source block to a supply voltage terminal and the second mirror transistor couples a reference output to the supply voltage terminal;

providing the mirror current via a series connection of a second resistor and a diode to the first terminal of the first resistor; and providing the reference voltage at the reference output, wherein the source block comprises a third terminal that is coupled to a reference potential terminal, a fourth terminal that is coupled to the supply voltage terminal, and a first and a second transistor that are cross coupled by a connection of a first terminal of the first transistor to a control terminal of the second transistor and a connection of a first terminal of the second transistor to a control terminal of the first transistor, and wherein the first transistor is arranged between the first terminal of the source block and the second terminal of the source block and the second transistor is arranged between the third terminal of the source block and the fourth terminal of the source block.

13. A voltage reference source, comprising: a source block; a first resistor having a first terminal coupled to a first terminal of the source block; a reference output for providing a reference voltage; a first and a second mirror transistor forming a first current mirror, wherein the first mirror transistor couples a second terminal of the source block to a supply voltage terminal and the second mirror transistor couples the reference output to the supply voltage terminal; a series connection of a second resistor and a diode that is arranged between the reference output and the first terminal of the first resistor such that a mirror current flows through the second mirror transistor and the series connection to the first terminal of the first resistor; and a current source which comprises a source resistor, wherein the source block comprises a third terminal that is directly coupled to a reference potential terminal and a fourth terminal that is coupled to the supply voltage terminal via the current source, and wherein a second terminal of the first resistor is directly connected to the reference potential terminal.

* * * * *